United States Patent [19]

Rünzi

[11] Patent Number: 4,558,858

[45] Date of Patent: Dec. 17, 1985

[54] SHEET SUPPLY APPARATUS FOR TYPEWRITERS, HAVING SLEWING ROLLERS ENGAGING A PLATEN ROLL, AND METHOD

[76] Inventor: Kurt Rünzi, Küsnachterstrasse 59, CH-8126 Zumikon, Switzerland

[21] Appl. No.: 536,862

[22] Filed: Sep. 29, 1983

[30] Foreign Application Priority Data

Oct. 12, 1982 [CH] Switzerland ..... 5957/82

[51] Int. Cl.[4] ..... B65H 3/32

[52] U.S. Cl. ..... 271/22; 271/127; 271/171; 271/117; 400/629

[58] Field of Search ..... 400/624, 625, 629; 271/21, 22, 24, 25, 117, 127, 171

[56] References Cited

U.S. PATENT DOCUMENTS

| | | | |
|---|---|---|---|
| 1,003,087 | 9/1911 | Brady . | |
| 1,017,134 | 2/1912 | Carter . | |
| 1,182,052 | 5/1916 | Stocking et al. . | |
| 1,965,827 | 7/1934 | Duncan | 271/22 X |
| 2,289,011 | 7/1942 | Hall . | |
| 2,351,854 | 6/1944 | Hall . | |
| 2,366,206 | 1/1945 | Metzner . | |
| 2,887,208 | 5/1959 | Cross . | |
| 3,110,489 | 11/1963 | Zahradnik | 271/22 |
| 3,210,071 | 10/1965 | Rogers | 271/22 X |
| 3,430,748 | 3/1969 | Parri . | |
| 3,586,317 | 6/1971 | Smitzer | 271/127 |
| 4,089,402 | 5/1978 | Hyland et al. . | |
| 4,212,456 | 7/1980 | Ruenzi . | |
| 4,221,374 | 9/1980 | Koch et al. . | |
| 4,222,557 | 9/1980 | Wu . | |
| 4,253,652 | 3/1981 | Steinhilber . | |
| 4,262,894 | 4/1981 | Marano | 400/625 X |
| 4,268,021 | 5/1981 | Rutishauser et al. . | |
| 4,275,969 | 5/1981 | Matsuhisa et al. . | |
| 4,277,059 | 7/1981 | Dunning . | |
| 4,280,693 | 7/1981 | Matsuhisa et al. . | |
| 4,326,815 | 4/1982 | Kapp | 400/625 |
| 4,340,314 | 7/1982 | Berger . | |
| 4,359,215 | 11/1982 | Ruenzi . | |
| 4,371,276 | 2/1983 | Mitrovich | 400/625 |
| 4,395,034 | 7/1983 | Fukui . | |
| 4,416,559 | 11/1983 | Steinhilber . | |
| 4,438,915 | 3/1984 | Akamatsu et al. . | |

FOREIGN PATENT DOCUMENTS

| | | |
|---|---|---|
| 3024036 | 1/1982 | Fed. Rep. of Germany . |

*Primary Examiner*—Richard A. Schacher

*Attorney, Agent, or Firm*—Frishauf, Holtz, Goodman & Woodward

[57] ABSTRACT

To provide for single-sheet feeding to an office-type writing apparatus, such as a typewriter, word processor, printer or the like, in form of a separable attachment unit, a unitary assembly is provided including two parallel rockers (2, 12) having lateral sheet guide walls (12) which are located on a common shaft (9) connecting side walls of the attachment apparatus. An abutment element (18) movable with the rockers is located adjacent the ends of the leading or feeding edge of sheets of a stack (6) placed on the rockers, the rockers each also including a sheet separating element (28) in form of a small triangle, pivotably secured to a holder plate (26), the base of the small triangle being spaced from the abutment element by a small distance (a) so that, upon engagement of a topmost sheet with a feed roller (15), driven, for example, intermittently to feed a sheet to the slewing mechanism of the writing apparatus by being coupled to the platen (3) thereof, the topmost sheet will be bowed slightly and thus readily separate from the sheet therebeneath.

20 Claims, 5 Drawing Figures

SHEET SUPPLY APPARATUS FOR TYPEWRITERS, HAVING SLEWING ROLLERS ENGAGING A PLATEN ROLL, AND METHOD

Reference to related publication: Swiss Pat. No. 611,577. Reference to related application by the inventor hereof: Ser. No. 536,863, filed Sept. 29, 1983, SHEET SUPPLY APPARATUS FOR TYPEWRITERS, HAVING SLEWING ROLLERS ENGAGING A PLATEN ROLL, AND METHOD.

The present invention relates to automatic typewriters, printers for word processors, output printers of all kinds, collectively referred to as "automatic writing machines", and more particularly to apparatus which can form an attachment to such writing machines to supply single sheets thereto, for example pre-printed letterheads and the like.

BACKGROUND

Various types of apparatus are known to provide single sheets to office-type machinery—see, for example, the referenced Swiss Patent No. 611,577.

THE INVENTION

It is an object to simplify single-sheet supply apparatus suitable for use in office writing apparatus which is compact, reliably feeds only a single sheet, and can be easily adapted to be used as an attachment with typewriter or printer apparatus of various manufacturers, while being versatile, for example by accepting paper sheets of various dimensions and, especially, various widths.

Briefly, a unitary assembly is provided which has two parallel rockers secured to a common shaft, so that they rock together about the same angle; the rockers are held in a frame which is adapted to be attached to the writing apparatus. The rockers hold a stack of sheets which are to be fed to the writing apparatus. An abutment element is located on the rockers, to move therewith, adjacent the leading or feeding edge of the sheets, and, further, sheet separating elements secured to pivotable plates or similar holders are attached to the rockers, to move therewith. A pair of feed rollers, driven whenever a sheet is to be supplied to the writing apparatus then can readily engage the topmost sheet from the stack and the separating elements will reliably separate the topmost sheet from the sheets therebeneath for feed of the topmost sheet only.

The arrangement is particularly suitable for universal construction as a single unitary assembly or attachment which can be secured to machines of different sizes and makes. By making the common shaft of non-round configuration, for example of square cross section, the rockers will always rock together within the frame structure. They are preferably formed with lateral guide plates, for example angled-off from a single element of sheet metal, so that various formats of sheets can be accepted, and interference in sheet feeding avoided. In accordance with a preferred feature of the invention, the feed rollers for the topmost sheet are located at predetermined positions with respect to the lateral guide elements of the rockers and move therewith, so that adaptation of the unitary assembly to different widths of sheets will, likewise, adapt the spacing of the feed rollers, and thus insure effective feed and separation of sheets since the topmost sheet will be propelled from positions which have a predetermined association or alignment with the sheet separating elements which, preferably, are sheet separating corners. A suitable drive system, to provide intermittent drive to the feed rollers, is described in detail in the referenced copending application Ser. No. 536,863, filed Sept. 29, 1983, by the inventor hereof.

DRAWINGS

DETAILED DESCRIPTION

Figure 1:
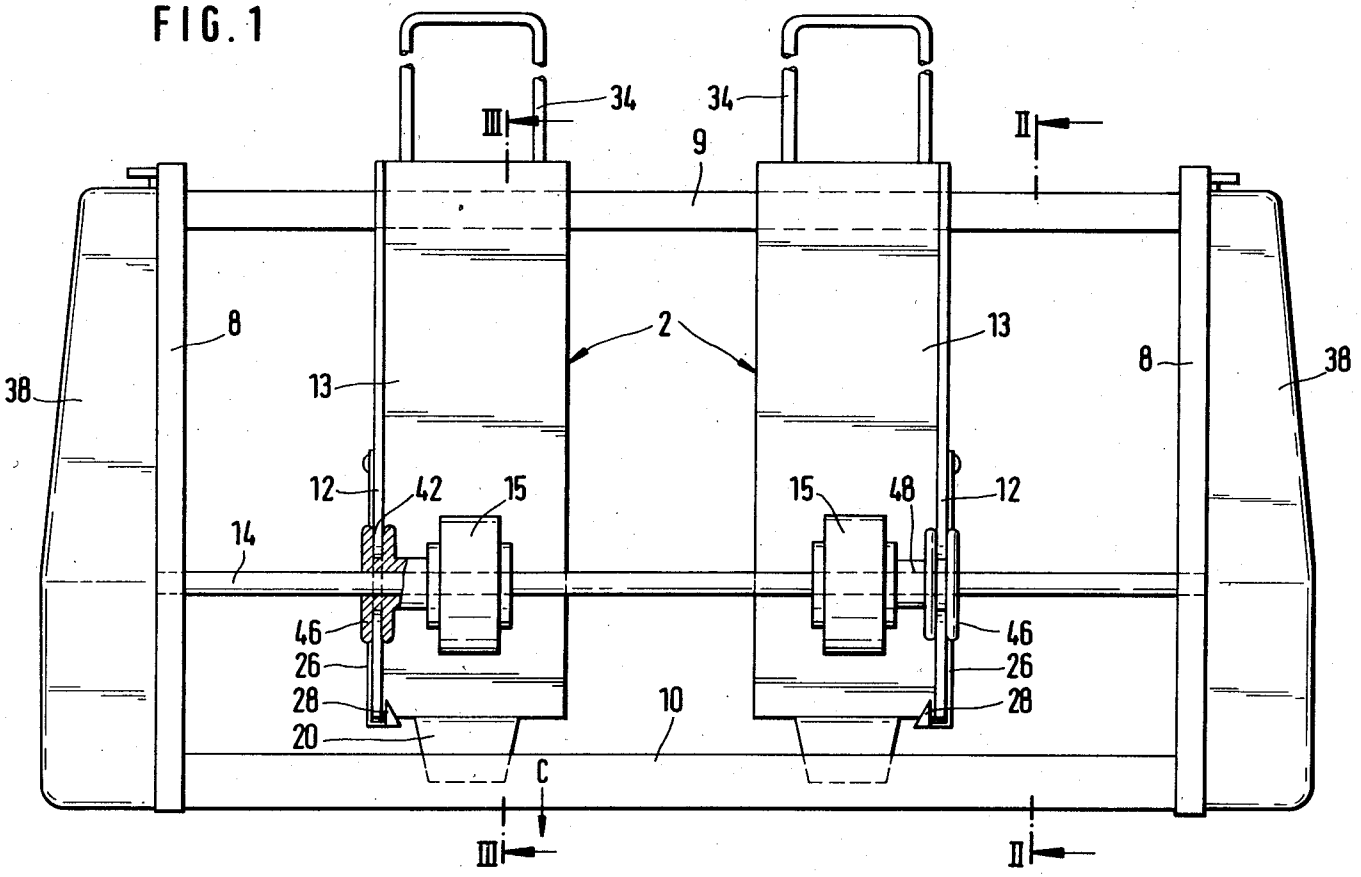
FIG. 1 is a top view of the apparatus, without sheets.
Figure 2:
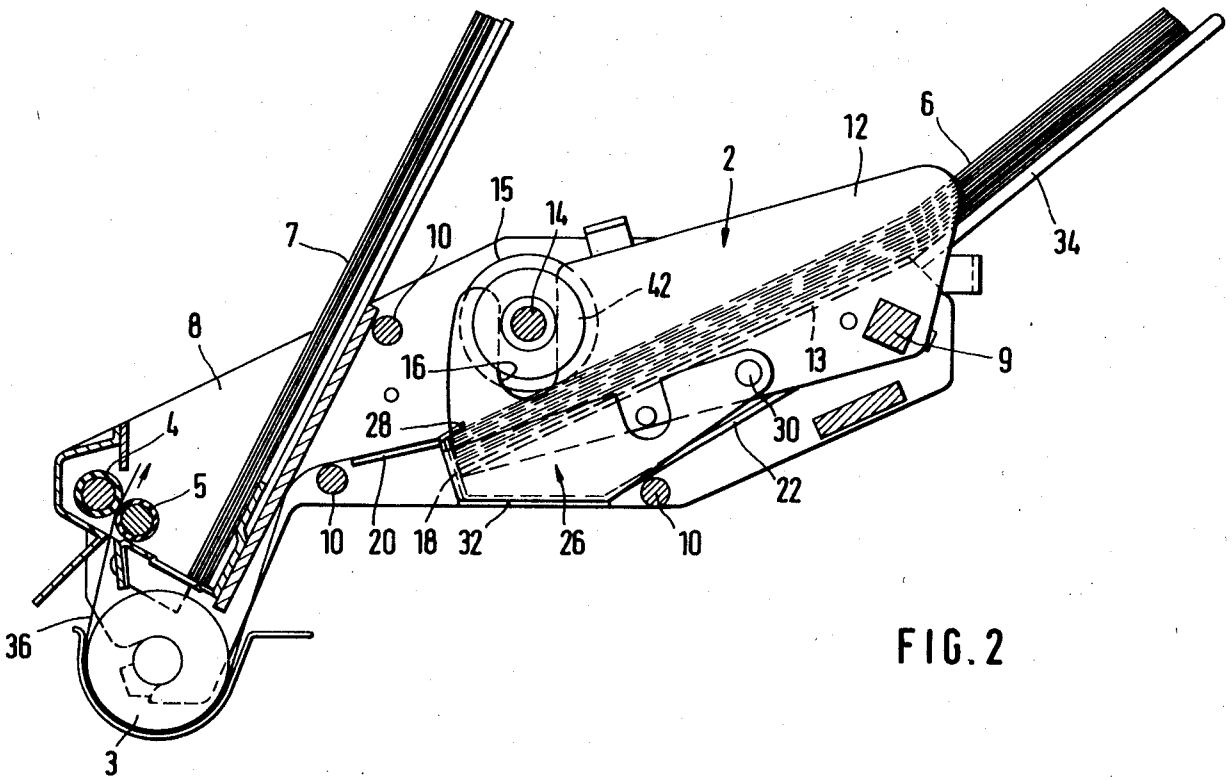
FIG. 2 is a section along line II—II of FIG. 1, with sheets placed thereon.

A stack of sheets 6 (FIG. 2) is located on two parallel rockers 2 (FIG. 1). The sheets are supplied to the typewriter by two intermittently rotated or driven feed rollers 15, to feed the sheets to the platen 3 of the typewriter. The sheets are transported within the typewriter, as is customary, by a typewriter slewing mechanism which, for example, may include a drive mechanism coupled to the platen and further pinch or supply rollers 4, 5 which grip the sheet for transport to a removal holder to form a written, typed stack 7.

The two rockers 2 are secured to a shaft 9 which, preferably, is square, so that the rockers will rock conjointly; any other polygonal, or egg-shaped configuration is also suitable. The shaft 9 is rotatable in two side walls 8 of the apparatus, which are held in spaced position by a cross brace 10 (FIG. 1) to form a support frame. Screws 11 (FIG. 3) secured to the rockers 2 can be used to secure the rockers 2 on the shaft 9, and prevent lateral shifting thereof. Any other suitable arrangement, such as a frictional holder, springs with detents, and the like, may also be used.

The non-round or polygonal configuration of the shaft 9 insures that both rockers 2 will rock conjointly or in synchronism. Each rocker has a lateral side wall 12. Each side wall 12 is formed with an upwardly open slit 16, to permit passage of a shaft 14 therethrough which retains the feed rollers 15. The arrangement permits rocking of the rockers 2 without interfering with the position of the feed rollers 15. To permit conjoint adjustment in axial direction of the respective feed rollers 15 on their operating shaft 14, and maintenance of spacing of the feed rollers 15 with respect to the end plates 12, spacer bushings 46 are seated on the shaft 14. The spacer bushings are formed with a circumferential groove which is engaged in the slit 16, with some play, so that the bushing 42 can rotate freely while moving the feed rollers 15 axially along the shaft 14 upon change of position of the rocker plate 12 on the rocker plate shaft 9. The spacer bushings are coupled to the feed rollers 15 for axial movement therewith.

A bottom plate 19 is provided. Bottom plate 19 is connected to the respective rocker 2. The connection of bottom plate 19 with the respective rocker 2 is by a pivot pivotable about a pivot axis 24, located approximately in the rear third portion of the respective rocker. Its forward edge is formed with an abutment 18 holding the stack 6 in position. The abutment 18 merges into a guide plate extension 20. The extension 20 is angled-off to extend approximately parallel with the sheets of the stack 6. The position of the extension 20 is so selected with respect to the circumference of the feed rollers 15 that the uppermost sheet of the stack 6 will be located approximately at the same height as the upper edge of the extension plate 20. The abutment 18 and the extension plate 20, together, form a right angle. A compression spring 40 is located between the plate 19 and a bottom platform plate 13 of the rocker 2. Spring 40 has the tendency to press the rocker 2, together with any sheets of the stack 6 which are supported on the support surface formed by platform 13 of the rocker, against the feed roller 15, so that there will be frictional engagement between the feed roller and the uppermost sheet of the stack 6.

Figure 3:
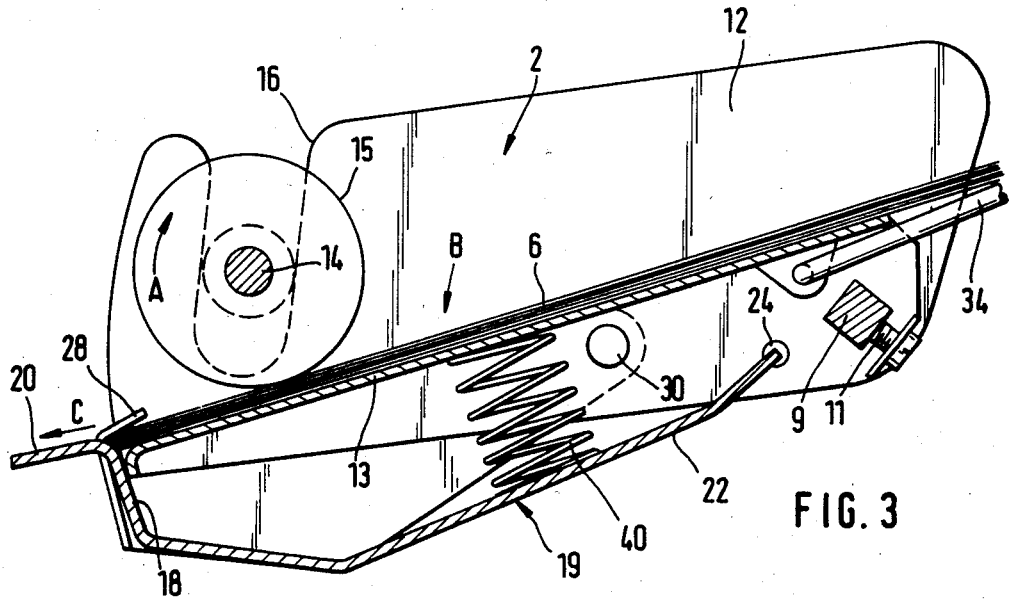
FIG. 3 is a section along line III—III of FIG. 1, without sheets.
Figure 4:
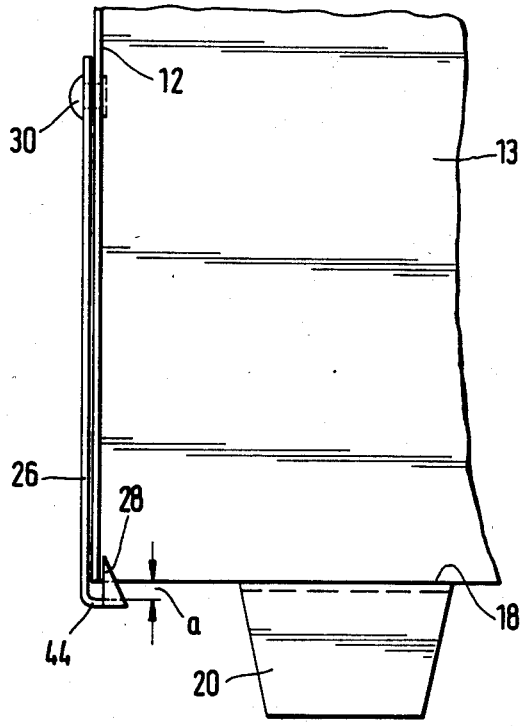
FIG. 4 is a top view to an enlarged scale of a detail of the rocker plate.
Figure 5:
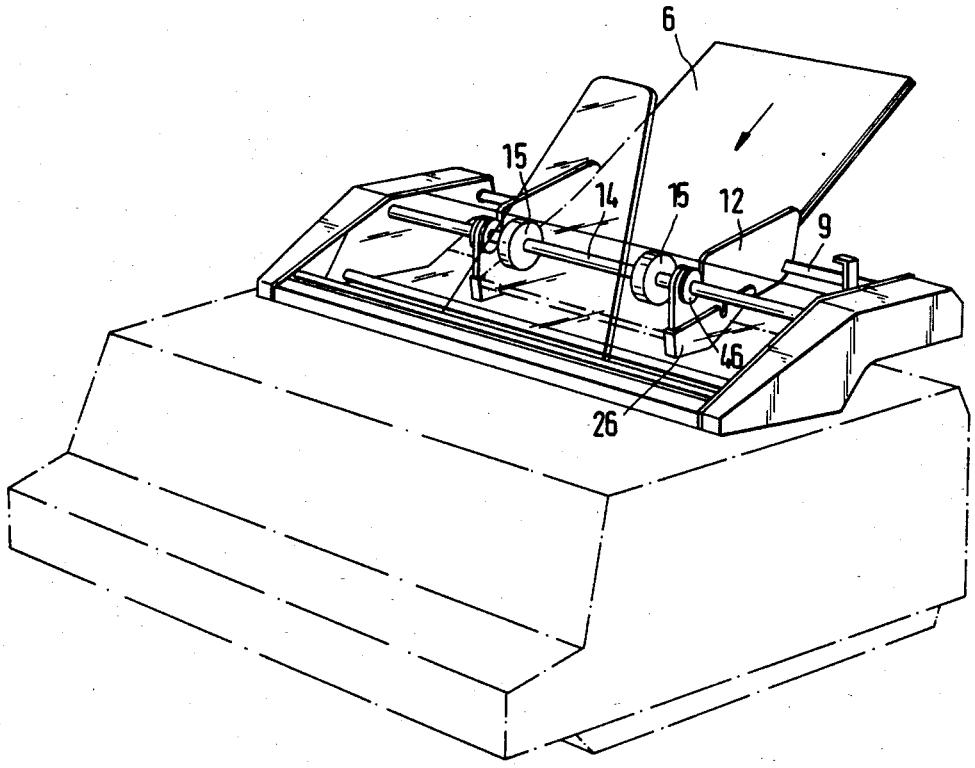
FIG. 5 is a general perspective view of the apparatus when associated with or combined with an office-type typewriter.

The respective sheets are fed, separately, to the writing apparatus. Feed of more than one sheet, for example by frictional adhesion of two sheets, is prevented by sheet separating elements 28 (FIGS. 1 and 4) which are located on opposite corners of the two rockers 2, and which extend over the sheets of the stack 6, as best seen in FIG. 4. Each separating element 28 is in form of a small triangle, secured to or forming part of an angled-off portion 44 of a pivot plate 26. Pivot plate 26, the angled-off part 44 and the separating element, preferably, are one unitary structure, for example a metal stamping or plastic element. The plate 26 is pivotable about a pivot axis 30, parallel to the axis of the rocker shaft 9. The two separating assemblies formed by elements 26, 44, 28 are constructed in mirror-image manner and secured to respectively opposite ones of the side plates 12 of the rockers 2. The plates 26 can move independently with respect to the rockers, as well as independently with respect to the plate 19. The plate 19 is engaged with its bottom against a fixed element 32 which, preferably, forms a portion of the frame of the unit, or a portion of the writing apparatus. The plate 26 is shaped to fit against the element 32 when the bottom 13 of the rocker 2 is moved downwardly—with respect to FIGS. 2, 3, that is, in the direction of the arrow B, for example to feed additional sheets into the stack. If comparatively long sheets are to be fed, a U-shaped bail 34 can extend the support region of the rockers; as shown, it can be pulled out from the back of each one of the rockers. The bail 34 may be made removable, and slidable to fit, at least in part, within the outline of the bottom of the respective rocker.

A small space a is formed between the abutment 18 and the angled-off portion 44 of the plate 26 carrying the separating corners or separating triangles 28. The stack 6, thus engages the abutment 18 and prevents pinching between the stack 6 and the corners 28.

The feed rollers 15 include, or are coupled to a drive mechanism with a free-wheeling clutch, so that a sheet fed in the direction of the arrow C (FIG. 3) upon rotation of the feed rollers in accordance with arrow A can move freely, and the feed rollers can move with the sheet, after it has been gripped by the slewing mechanism of the writing apparatus. Thus, rollers 15 can rotate freely in feeding direction even though the drive shaft 15 therefor may be stationary.

The side walls 8 of the apparatus are connected by frame elements 10. Covers 38 are located on the side walls 8, the covers 38 including the drive mechanisms for the shaft 14 and hence for the feed rollers 15. Preferably, the arrangement is such that movement for the feed rollers is obtained directly from rotation of the platen 3; gear belts and the like, transferring rotation to the drive shaft 14 with interposition of a lost-motion or intermittent gearing is particularly suitable. The referenced application by the inventor hereof, Ser. No. 536,863, filed Sept. 29, 1983, the disclosure of which is hereby incorporated by reference, describes a particularly suitable arrangement.

Operation: To provide a stack of sheets 6, a stack is located on the rockers 2 and placed beneath the feed rollers 15 upon exerting pressure against the bottom 13 of the rockers, in the direction of the arrow B (FIG. 3). The stack of the new sheets is so placed that the sheets will be located beneath the separating corners or triangles 28.

Upon rotation of the feed rollers 15 in direction of the arrow A, the uppermost sheet is gripped frictionally and transported in the direction of the arrow C (FIG. 3). Initial movement of the uppermost sheet in transport direction—arrow C—is impeded by the separating corners or triangles 28. Since the feed rollers 15 are located near the side edges of the sheets, and the separating corners are triangular, the sheets 15 will bow and, due to the bowing, the leading corners or edges will jump over the separating corners 28. This arrangement simply and effectively prevents feeding of more than one sheet from a stack.

Various changes and modifications may be made, and any features described can be used in combination with any of the others, within the scope of the inventive concept.

I claim:

1. Single-sheet feed apparatus for office-type automatic writing machines, having a frame (8, 10) including spaced side elements (8), a rotatable shaft (14) and at least two feed rollers (15) rotatable with said shaft, and comprising an assembly including two parallel rockers (2, 12) having a support surface (13);

a common shaft (9) extending between the side elements (8) and securing the rockers thereon for common rocking movement about the axis of the shaft, upon rocking movement of said shaft, while permitting axial shifting movement of the rockers on the shaft;

an abutment element (18) located adjacent the end of each rocker at the leading or feeding edge of the sheets and axially movable with the rockers;

sheet separating elements (28) located adjacent the corners of the leading edges of the sheets and axially movable with the rockers;

wherein the rotatable shaft (14) extends parallel to said common shaft (9);

and engagement elements (46, 48) are provided coupled to move with the support surfaces of the respective rockers and moving the respective feed rollers axially along the rotatable shaft (14)

upon axial shifting of the respective rockers.

2. Apparatus according to claim 1, including lateral upstanding walls (12), projecting laterally adjacent to the support surfaces of the rockers and coupled to the rockers for axial shifting along the common shaft (9), the upstanding walls being formed with an opening (16) through which the shaft (14) for the feed rollers (15) extends;

and wherein the engagement elements include follower bushings (46) secured in the openings (16) of the lateral walls (12) and coupled to respective feed rollers (15) to carry the feed rollers axially upon axial shifting of the respective rockers along the common shaft (9).

3. Apparatus according to claim 1, wherein the abutment element (18) includes a bottom plate (19) extending along the lower portion of the rocker (2).

4. Apparatus according to claim 3, wherein the rockers include a bottom platform plate (13) and compression springs (40) are provided located between the bottom plate (19) and the bottom platform plate (13) of each rocker.

5. Apparatus according to claim 3, further including a common step element (32) positioning the abutment element (18) and the sheet separating elements (28) in predetermined relative alignment.

6. Apparatus according to claim 5, wherein the separating elements comprise small triangular portions extending adjacent the abutment element (18) in the corners of the path of the leading edge of the topmost sheet of the stack (6).

7. Apparatus according to claim 1, further including movable bails (34) secured to each of the rockers (2) at the portion thereof adjacent the trailing or rear portion of the sheets to provide for support of the rear portions of the sheets.

8. Apparatus according to claim 1, wherein the sheet separating elements (28) comprise small corner or triangle elements located, in mirror-image position, adjacent the corners of the rockers to engage the leading edge of a sheet from the stack of sheets, the corner elements having an end surface overlapping the edges of sheets placed on the rockers, and being spaced—in feeding direction of the sheets—by a predetermined distance (a) from the abutment element (18) to provide for bowing of a sheet being fed towards the separating elements, and hence insure separation of feed from a stack of sheets.

9. Apparatus according to claim 1, wherein the abutment element (18) includes a bottom plate (19) extending along the lower portion of the rocker (2) and pivotal connection means (24) located in the rearmost third portion of the respective rocker connecting the bottom plate and the abutment element to the rocker.

10. Apparatus according to claim 1 wherein the openings (16) in the upstanding walls of the rockers are slit-like, and the engagement elements (46) are fitted in the slit-like opening.

11. Apparatus according to claim 1, including movable holding elements (26) secured to and retaining the sheet separating elements (28) movably located in the apparatus for pivoting movement about an axis (30) parallel to the axis of the common shaft (9) and axially movable with the rockers (2, 12).

12. Apparatus according to claim 1, including pivotable holding elements (26) secured to and retaining the sheet separating elements (28) pivotably located in the apparatus for pivoting movement about an axis (30) parallel to the axis of the common shaft (9) and axially movable with the rockers (2, 12).

13. Single sheet feed apparatus for office-type automatic writing machines, having a frame (8, 10) including spaced side elements (8), and comprising an assembly including two parallel rockers (2, 12);

a common shaft (9) extending between the side elements (8) and securing the rockers thereon for common rocking movement about the axis of the shaft upon rocking movement of said shaft, while permitting axial shifting movement of the rockers on the shaft;

the rockers having a support surface (13) for holding a stack of sheets to be fed with a leading edge to the writing machine;

a rotatable shaft (14) and at least two feed rollers (15) placed on said shaft extending between said side elements and parallel to said common shaft;

and engagement elements (46, 48) one, each, coupled to a respective rocker and a feed roller for moving the respective feed roller axially along the rotatable shaft (14) upon axial shifting of the respective rockers to retain the relative position of the feed rollers with respect to the rockers.

14. Apparatus according to claim 13 wherein each of the rockers includes a movable plate (13) to retain sheets (6) thereon and a lateral upstanding wall (12) positioned adjacent the movable plate and axially movable with the movable plate (13) of the rockers along the common shaft (9), the upstanding wall being formed with an opening (16) through which the rotatable shaft (14) for the feed rollers (15) extends;

and wherein the engagement elements include follower bushings (46) secured in the opening of the lateral walls (12) and coupled to the respective feed rollers (15) to carry the feed rollers axially upon axial shifting of the respective rocker and the associated lateral wall along the common shaft (9).

15. Apparatus according to claim 14 further including a bottom plate (19) axially shiftable with the rockers and positioned below the movable plate (13) of the rockers;

and a compression spring (40) located between said bottom plate (19) and the movable plate (13) to press the sheets (6) on the movable plate (13) towards the feed rollers (15).

16. Apparatus according to claim 15 including means for supporting said bottom plate (19) in axially shiftable position conjointly with said rockers, and in essentially predetermined position with respect to the axis of said common shaft (9) to relate the compression force of said spring (40) to the relative position of the spring with respect to said common shaft (9).

17. Apparatus according to claim 15 further comprising sheet separating elements (28) located adjacent opposite corners of the rockers and being axially moveable with the rockers;

and abutment means associated with each rocker and axially moveable with the respective rocker, said abutment means being positioned to be engaged by the respective sheet separating elements to space the sheet separating elements by a predetermined distance above the movable plate (13) when the movable plate is moved downwardly upon feeding of additional sheets into the stack.

18. Single sheet feed apparatus for office-type automatic writing machines, having a frame (8, 10) including spaced side elements (8), and comprising an assembly including two parallel rockers (2, 12), a common shaft (9) extending between the side elements (8) and securing the rockers thereon for common rocking movement about the axis of the shaft upon rocking movement of said shaft, while permitting axial shifting movement of the rockers on the shaft, the rockers each having a movable support plate (13) for holding a stack of sheets (6) to be fed with a leading edge to the writing machine, and a bottom plate;

a rotatable shaft (14) and at least two feed rollers (15) placed on said rotatable shaft extending between said side elements (8) and parallel to said common shaft (9);

engagement elements (46, 48) one, each, coupled to a respective rocker and a feed roller for moving the respective feed roller axially along the rotatable shaft (14) upon axial shifting of the associated respective rocker to retain the relative position of the feed rollers with respect to the rockers;

two lateral upstanding walls (12) positioned adjacent the respective support plates (13) of the rockers, and axially movable with the respective rockers;

a compression spring (40) located between the respective bottom plate (19) and the movable support plate (13) of the rocker to bias the support plate in a direction against the associated feed roller (15);

two sheet separating elements (28) located adjacent opposite corners of respective rockers and being axially removable with the rockers; and abutment means (32) engageable by said separating elements for engaging the separating elements (28) against the abutment means and reliably positioning sheets of a stack of sheets beneath the separating elements (28) when the support plate (13) is moved downwardly against the bias force of the compression spring upon feeding of additional sheets into the stack (6).

19. Apparatus according to claim 18 wherein the movable support plate of each rocker, and the associated upstanding wall (12) comprises a unitary element.

20. Apparatus according to claim 18 wherein the bottom plate (19) of a respective rocker is movably secured to the respective lateral upstanding wall (12) of the rocker.

* * * * *

UNITED STATES PATENT AND TRADEMARK OFFICE

CERTIFICATE OF CORRECTION

PATENT NO. : 4,558,858

DATED : December 17, 1985

INVENTOR(S) : Kurt RUNZI

It is certified that error appears in the above-identified patent and that said Letters Patent is hereby corrected as shown below:

Claim 18, column 8, line 5, change "removable" to --movable--

Signed and Sealed this

*Twenty-seventh* Day of *May 1986*

[SEAL]

*Attest:*

DONALD J. QUIGG

*Attesting Officer*

*Commissioner of Patents and Trademarks*